US008551256B2

(12) United States Patent
Lee et al.

(10) Patent No.: US 8,551,256 B2
(45) Date of Patent: Oct. 8, 2013

(54) WASHING MACHINE AND WASHING CONTROL METHOD OF THE SAME

(75) Inventors: Bo Ram Lee, Yongin-si (KR); Sang Yeon Pyo, Suwon-si (KR); Hyun Sook Kim, Suwon-si (KR); Sung Hoon Kim, Suwon-si (KR); Seong Min Oak, Masan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 410 days.

(21) Appl. No.: 11/892,406

(22) Filed: Aug. 22, 2007

(65) Prior Publication Data

US 2008/0099052 A1 May 1, 2008

(30) Foreign Application Priority Data

Nov. 1, 2006 (KR) ..... 10-2006-0107215

(51) Int. Cl.
*B08B 7/04* (2006.01)
*D06F 33/00* (2006.01)

(52) U.S. Cl.
USPC ..... 134/18; 68/12.12; 68/12.04; 8/158

(58) Field of Classification Search
USPC ..... 8/158; 134/18; 68/12.04, 12.12
See application file for complete search history.

(56) References Cited

U.S. PATENT DOCUMENTS

| | | | | |
|---|---|---|---|---|
| 4,118,189 | A * | 10/1978 | Reinwald et al. | 8/137 |
| 5,042,276 | A * | 8/1991 | Kamano et al. | 68/12.04 |
| 5,295,373 | A | 3/1994 | Lim et al. | |
| 5,590,551 | A * | 1/1997 | Hong | 68/183 |
| 6,662,600 | B1 * | 12/2003 | Field et al. | 68/17 R |
| 2003/0230122 | A1 | 12/2003 | Lee | |
| 2004/0040344 | A1 * | 3/2004 | Minayoshi et al. | 68/12.16 |
| 2005/0034491 | A1 * | 2/2005 | Tazawa et al. | 68/12.03 |
| 2006/0107468 | A1 * | 5/2006 | Urbanet et al. | 8/158 |

FOREIGN PATENT DOCUMENTS

| | | | |
|---|---|---|---|
| CN | 1606643 | | 4/2005 |
| EP | 0 495 168 | A1 | 7/1992 |
| EP | 495168 | A1 * | 7/1992 |
| EP | 1 302 585 | | 4/2003 |
| EP | 1 505 193 | | 2/2005 |
| EP | 1 870 505 | | 12/2007 |
| JP | 03016593 | * | 1/1991 |
| JP | 2003-000982 | | 1/2003 |
| JP | 2006075478 | * | 3/2006 |
| JP | 2006075478 | A * | 3/2006 |
| WO | 00/06821 | | 2/2000 |
| WO | 2006/097362 | | 9/2006 |

OTHER PUBLICATIONS

Machine translation of JP 2006-075478 (Mar. 2006).*

(Continued)

*Primary Examiner* — Michael Kornakov
*Assistant Examiner* — Katelyn Whatley
(74) *Attorney, Agent, or Firm* — Staas & Halsey LLP

(57) ABSTRACT

A washing machine and a washing control method of the same that is capable of controlling laundry to be effectively washed with bubbles depending upon load of the washing machine and types of the laundry. The washing control method includes detecting the amount of load depending upon the weight of laundry, controlling the amount of wetting water according to the detected amount of load to wet the laundry, and generating bubbles to wash the laundry.

10 Claims, 7 Drawing Sheets

(56) References Cited

OTHER PUBLICATIONS

Abstract of JP 03-016593 (Jan. 1991).*
Office Action issued Oct. 10, 2008 in corresponding Russian Patent Application No. 2007132752.
European Search Report issued Mar. 31, 2008 in corresponding European Patent Application No. 07115024.7-2314.
Chinese Office Action for corresponding Chinese Application 200710147135.0; issued Nov. 27, 2009.

* cited by examiner

WASHING MACHINE AND WASHING CONTROL METHOD OF THE SAME

CROSS-REFERENCE TO RELATED APPLICATIONS

This application claims the benefit of Korean Patent Application No. 10-2006-0107215, filed on Nov. 1, 2006 in the Korean Intellectual Property Office, the disclosure of which is incorporated herein by reference.

BACKGROUND

1. Field

The present invention relates to a washing machine and a washing control method of the same that is capable of washing laundry with bubbles. More particularly, to a washing machine and a washing control method of the same that is capable of controlling laundry to be effectively washed with bubbles depending upon load of the washing machine and kinds of the laundry.

2. Description of the Related Art

A conventional washing machine (i.e, a drum type washing machine) is a washing machine, including a drum-type water tub to receive wash water and a cylindrical rotary drum rotatably mounted in the water tub to receive laundry which washes the laundry by lifting and dropping the laundry in the rotary drum during rotation of the rotary drum.

The conventional washing machine detects the weight of laundry (i.e., the amount of load) to determine the amount of wash water according to a user's selection of a washing course, supplies water having an amount sufficient to wet the laundry and detergent into the water tub according to the determined amount of wash water, heats the water and the detergent supplied into the water tub using a heater mounted at the lower part of the washing machine when heating washing is to be performed, and performs a washing operation while the detergent water (i.e., the water plus the detergent), the temperature of which is increased by the heater, is forwarded to the laundry and the laundry is dropped by the rotation of the rotary drum.

However, when using the conventional washing machine, it is necessary to fill a space defined between the water tub and the rotary drum with water to perform the washing. As a result, a large amount of water is used, and therefore, a large amount of energy is required to increase the temperature of the water. Also, as water consumption increases, a large amount of detergent is used to perform high-concentration washing.

Furthermore, laundry, such as wool or silk requiring delicate washing, may be damaged due to the falling of the laundry, the friction between the water and the laundry and the friction between laundry articles caused by the rotation of the rotary drum.

SUMMARY

Accordingly, it is an aspect of the present invention to provide a washing machine and a washing control method of the same that is capable of performing washing using bubbles, thereby increasing washability by virtue of high-concentration detergent on bubble surfaces while reducing water consumption.

It is another aspect of the present invention to provide a washing machine and a washing control method of the same that is capable of wetting laundry before bubble generation such that the bubbles easily permeate into the laundry, thereby accomplishing the optimum washing efficiency using the bubbles.

It is another aspect of the present invention to provide a washing machine and a washing control method of the same that is capable of controlling the amount of wetting water necessary to wet laundry depending upon load of the washing machine, thereby supplying water having an amount adequate to accomplish the optimum wetting efficiency.

It is yet another aspect of the present invention to provide a washing machine and a washing control method of the same that is capable of performing wetting control to wet laundry depending upon kinds of the laundry, thereby reducing the damage to the laundry in small-load delicate washing, in which the wetting control is unnecessary, and reducing washing time.

Additional aspects and/or advantages will be set forth in part in the description which follows and, in part, will be apparent from the description, or may be learned by practice of the invention.

The foregoing and/or other aspects of the present invention are achieved by providing a washing control method of a washing machine to perform washing using bubbles, the method including detecting an amount of load depending upon a weight of laundry in the washing machine, controlling an amount of wetting water according to the detected amount of load to wet the laundry, and generating bubbles to wash the laundry.

According to an aspect of the present invention, controlling the amount of wetting water according to the amount of load includes increasing the amount of wetting water as the amount of load increases.

According to an aspect of the present invention, increasing the amount of wetting water includes increasing a number of wetting operations (i.e., wetting times) to wet the laundry or increasing an amount of water to be supplied for a one-time wetting operation.

According to an aspect of the present invention, wetting the laundry includes supplying wash water to wet the laundry, and operating a rotary drum at an RPM and operation rate set depending upon the amount of load for a predetermined period of time.

According to an aspect of the present invention, the washing control method further includes selecting a washing course based upon types of laundry. According to an aspect of the present invention, when the selected washing course is normal washing, the laundry is wetted before the bubble generation, and then bubble washing is performed. According to an aspect of the present invention, when the selected washing course is delicate washing, the bubble washing is performed without wetting the laundry.

According to an aspect of the present invention, generating bubbles to wash the laundry includes supplying wash water and detergent into a water tub, heating concentrated detergent liquid including the wash water and the detergent mixed with each other, generating and supplying bubbles into the water tub when a temperature of the heated concentrated detergent liquid reaches a predetermined bubble generation temperature, and washing the laundry with the supplied bubbles.

According to an aspect of the present invention, supplying the wash water and the detergent into the water tub includes supplying the wash water and the detergent into a space defined between a rotary drum, in which the laundry is put, and the water tub such that the wash water and the detergent are not brought into contact with the laundry.

According to an aspect of the present invention, the washing control method further includes detecting a water level of the concentrated detergent liquid including the wash water and the detergent mixed with each other.

According to an aspect of the present invention, the water level of the concentrated detergent liquid is controlled to be maintained at a bubble generation water level at which the bubbles are generated, while the concentrated detergent liquid is not in contact with the laundry.

According to an aspect of the present invention, when the concentrated detergent liquid is at the bubble generation water level, the bubbles are generated.

According to an aspect of the present invention, when the bubbles are generated exceeding a water level suitable for washing, a rotary drum, in which the laundry is put, is rotated.

According to an aspect of the present invention, the washing control method further includes detecting the water level of the concentrated detergent liquid changed depending upon the bubble generation, and resupplying wash water when the detected water level reaches a second water level which is a minimum water level necessary for the bubble generation.

According to an aspect of the present invention, the second water level is a heater safety water level necessary to drive a washing heater during hot water washing using bubbles.

According to an aspect of the present invention, the washing control method further includes setting a number of water resupply operations (i.e., water resupplies) to resupply wash water depending upon the amount of load, and resupplying the wash water includes controlling a water resupply action based on the set number of water resupply operations.

According to an aspect of the present invention, the washing control method further includes driving a washing heater to heat the concentrated detergent liquid to a user-predetermined temperature when the temperature of the concentrated detergent liquid reaches the bubble generation temperature, and heating the concentrated detergent liquid to the user-predetermined temperature is carried out along with the bubble generation.

It is another aspect of the present invention to provide a washing machine, having a water tub and a rotary drum to receive laundry, to perform washing using bubbles, the washing machine including a water supply unit to supply wash water, a bubble generation unit to generate bubbles, and a control unit to control the water supply unit to directly supply the wash water into the water tub before bubble generation, to control the bubble generation unit to generate bubbles from the supplied wash water, and to perform the washing using the generated bubbles.

According to an aspect of the present invention, the control unit detects the amount of load depending upon a weight of the laundry and controls the supply of wash water into the water tub to control the amount of wetting water suitable for wetting the laundry depending upon the detected amount of load.

According to an aspect of the present invention, the control unit increases the amount of wetting water as the amount of load increases. That is, the control unit increases a number of wetting operations (i.e., wetting times) to wet the laundry or increases an amount of water to be supplied for a one-time wetting operation, to increase the amount of wetting water.

According to an aspect of the present invention, the washing machine further includes an input unit to select a washing course-depending upon types of the laundry, and when the selected washing course is normal washing, the control unit controls the water supply unit to directly supply wash water into the water tub such that the laundry is wetted and then the bubble washing is performed.

According to an aspect of the present invention, when the selected washing course is delicate washing, the control unit controls the water supply unit to supply wash water and detergent into a space defined between the water tub and the rotary drum and performs the bubble washing without wetting the laundry.

According to an aspect of the present invention, the washing machine further includes a detergent supply unit to store detergent and a water supply pipe to supply wash water to the detergent supply unit, and the water supply unit supplies the wash water to the detergent supply unit such that the detergent stored in the detergent supply unit is dissolved to form concentrated detergent liquid.

According to an aspect of the present invention, the washing machine further includes a water replenishment pipe diverging from the water supply pipe to replenish wash water, and the water supply unit directly supplies the wash water into the water tub through the water replenishment pipe and not through the detergent supply unit.

According to an aspect of the present invention, the control unit controls the water supply unit to directly supply the wash water into the water tub through the water replenishment pipe, to wet the laundry before the wash water and the detergent are supplied into the space between the water tub and the rotary drum.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE EMBODIMENTS

Figure 1:
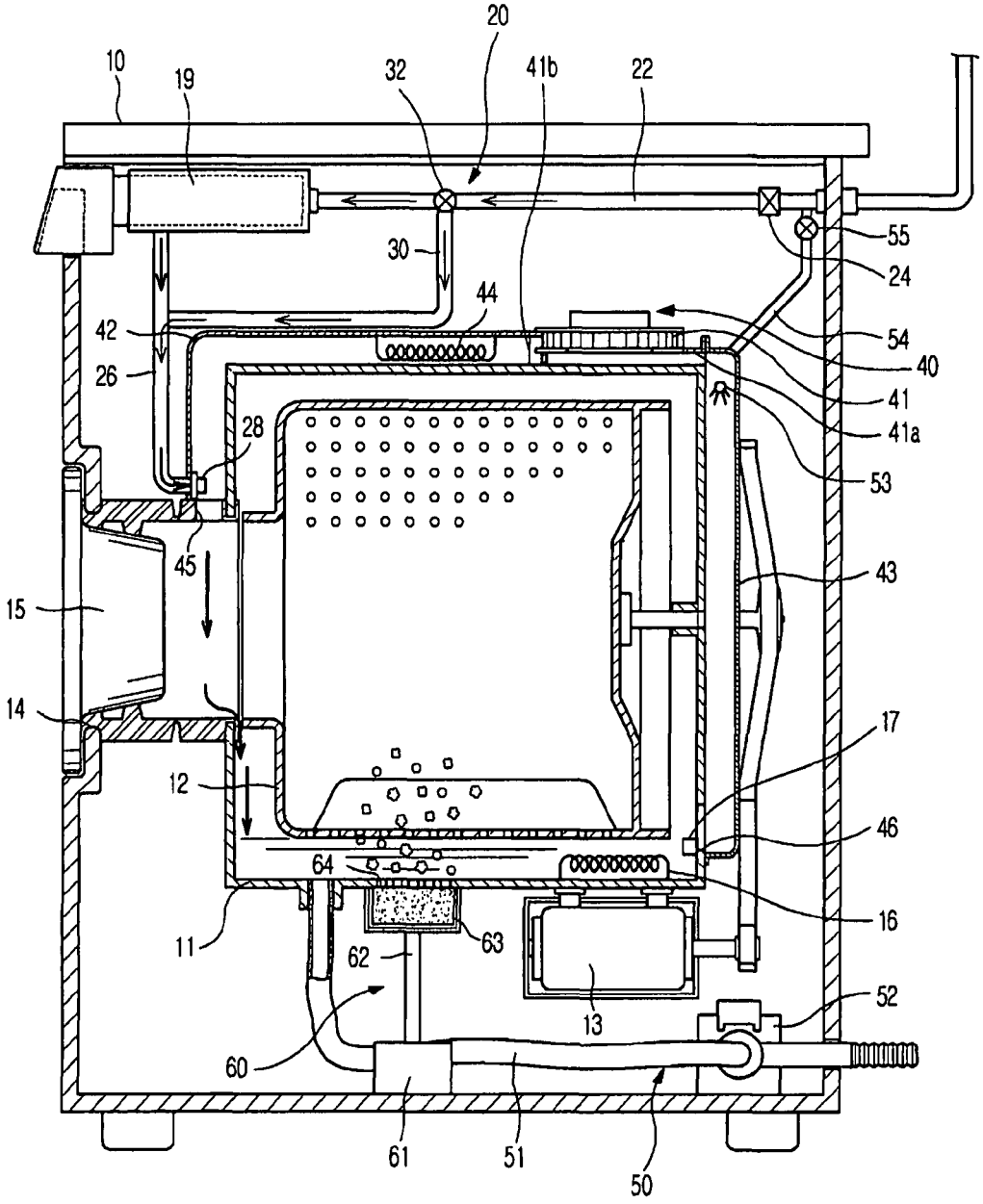
FIG. 1 is a sectional view illustrating the structure of a washing machine according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

FIG. 1 is a sectional view illustrating the structure of a washing machine using bubbles according to the present invention.

As shown in FIG. 1, the washing machine comprises a drum-type water tub 11 mounted in a machine body 10 to receive wash water and a rotary drum 12 rotatably mounted in the water tub 11 and having a plurality of through-holes.

A motor 13 is mounted at the bottom of the water tub 11, to rotate the rotary drum 12 in alternating directions to perform washing, rinsing, and spin-drying operations. In the lower part of the water tub 11 are mounted a washing heater 16 to heat the wash water supplied into the water tub 11 according to a user's selection of water temperature and a water level sensor 17 to detect a frequency changed depending upon the water level of the wash water (or concentrated detergent liquid) supplied into the water tub 11 to detect the amount (i.e., the water level) of the wash water (or the concentrated detergent liquid).

The water level sensor 17 controls a maximum wash water level at which concentrated detergent liquid is not introduced into the rotary drum 12, in which laundry is put (i.e., an optimum water level necessary for bubble generation; hereinafter, referred to as a first water level), to perform washing using bubbles and a minimum wash water level necessary for the bubble generation (a safety water level at which the washing heater is submerged in the detergent water; hereinafter, referred to as a "second water level"). When the amount of the concentrated detergent liquid supplied upon the washing reaches the first water level, the supply of wash water is stopped to prevent the introduction of the concentrated detergent liquid into the rotary drum 12. When the amount of the concentrated detergent liquid is lowered to the second water level due to the bubble generation, wash water is supplied into the water tub 11 to maintain concentrated detergent liquid necessary for the bubble generation.

Also, the water level sensor 17 controls the concentrated detergent liquid to be maintained at a bubble generation water level at which the bubble generation is possible while the concentrated detergent liquid is not in contact with the laundry through the continuous water level detection in addition to the first and second water levels. Furthermore, the water level sensor 17 measures the lowering of the water level through flow rate control or time control during bubble washing to control wash water having an amount necessary for the bubble generation to be supplied.

Also, the water level sensor 17 controls a wash water level at which the laundry is wetted before the bubble generation (i.e., the amount of wetting water set depending upon load of the washing machine and types of the laundry; hereinafter, referred to as a "third water level"). The laundry is controlled to be wetted before the bubble generation such that bubbles easily permeate into the laundry during washing.

In the front of the water tub 11 and the rotary drum 12 are formed openings 14, which are opened and closed by a door 15 mounted at the front of the machine body 10.

Above the water tub 11 are mounted a detergent supply unit 19 to supply detergent, and a water supply unit 20 to supply wash water.

The detergent supply unit 19 has several partitioned spaces, according to an embodiment of the present invention. Further, according to an embodiment of the present invention, the detergent supply unit 19 is mounted at the front side of the machine body 10 such that a user easily puts detergent and rinse in the partitioned spaces.

The water supply unit 20 comprises a water supply pipe 22 to supply wash water and a water supply valve 24 mounted on the water supply pipe 22 to control the supply of wash water through the water supply pipe 22. The water supply pipe 22 is connected with the detergent supply unit 19 such that water can be supplied from the outside to the detergent supply unit 19.

A connection pipe 26 is mounted between the detergent supply unit 19 and the water tub 11, through which the wash water having passed through the detergent supply unit 19 is supplied to the water tub 11 together with the detergent. A water supply nozzle 28 is mounted at the outlet of the connection pipe 26, through which the detergent in the detergent supply unit 19 is supplied into the water tub 11 together with the wash water to receive high-concentration detergent liquid for bubble generation in a space defined between the water tub 11 and the rotary drum 12.

Also, the water supply unit 20 further comprises a water replenishment pipe 30 connected to the water supply pipe 22 to replenish wash water to wet the laundry before bubble generation or replenish wash water necessary for bubble generation, when the water level is lowered due to the bubble generation, and a water replenishment valve 32 mounted on the water replenishment pipe 30 to control the replenishment of wash water to the water tub 11. The water replenishment pipe 30 is connected with the connection pipe 26 such that water passing through the water supply pipe 22 is directly supplied to the water tub 11 not through the detergent supply unit 19.

According to an embodiment of the present invention, the water replenishment valve 32 is a three-way valve to control the flow of the wash water such that the wash water passing through the water supply pipe 22 is supplied to the detergent supply unit 19 or the water replenishment pipe 30.

The washing machine according to an embodiment of the present invention further comprises a drying unit 40 to dry laundry (i.e., clothes). The drying unit 40 comprises a drying fan 41 mounted at the top of the water tub 11, a drying duct 42 connected between an outlet port 41*b* of the drying fan 41 and an air inlet port 45 formed at the upper side of the opening 14 of the water tub 11, and an condensing duct 43 mounted at the rear of the water tub 11 to connect an air outlet port 46 formed at the lower part of the rear side of the water tub 11 and an inlet port 41*a* of the drying fan 41.

The drying unit 40 further comprises a drying heater 44 mounted in the drying duct 42 to supply hot air into the water tub 11 and an condensing unit mounted in the condensing duct 43 to condense wet steam generated during drying of the clothes.

The condensing unit comprises a cooling water injection nozzle 53 mounted in upper part of the condensing duct 43 to inject cooling water into the condensing duct 43 and a cooling water supply pipe 54 and a cooling water valve 55 connected to the water supply unit 20 to supply cooling water to the cooling water injection nozzle 53. Consequently, cooling water injected from the cooling water injection nozzle 53 falls downward along the condensing duct 43 with the result that the cooling water is brought into contact with wet air rising upward, whereby the dehumidification efficiency is improved.

The washing machine according to an embodiment of the present invention further comprises a drainage unit 50 to drain water out of the water tub 11. The drainage unit 50 comprises a drainage pipe 51 connected to the bottom of the water tub 11 to guide the water in the water tub 11 to the outside and a drainage pump 52 mounted at the drainage pipe 51.

The washing machine according to an embodiment of the present invention further comprises an air supply unit 60 to supply air such that the laundry in the rotary drum 12 is washed by bubbles. The air supply unit 60 comprises an air motor 61 mounted below the water tub 11 to supply air, an air supply pipe 62 to forward the air supplied by the air motor 61, and a porous member 63 mounted at one end of the air supply pipe 62 to disperse the supplied air. The air supplied by the air motor 61 passes through the porous member 63 via the air supply pipe 62. At this time, the air is dispersed to generate bubbles in detergent water having concentrated detergent liquid and wash water mixed with each other. Consequently, it is possible to wash the laundry in the rotary drum 12 only using the bubbles.

Air holes 64 are formed in the water tub 11 where the air supply unit 60 is mounted, through which air from the air supply unit 60 is flows. Consequently, air dispersed by the porous member 63 is introduced into a space between the water tub 11 and the rotary drum 12 through the air holes 64.

Figure 2:
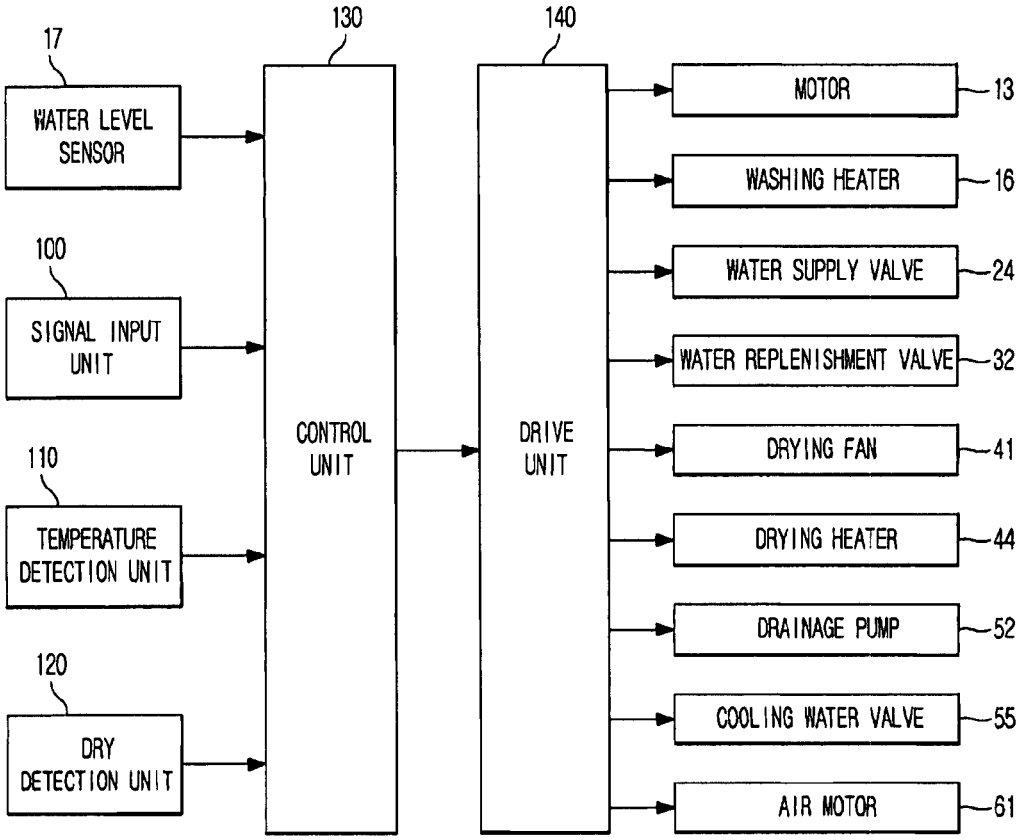
FIG. 2 is a control block diagram of a washing control unit of the washing machine according to an embodiment of the present invention.

FIG. 2 is a control block diagram of a washing control unit of the washing machine according to an embodiment of the present invention. In addition to the components shown in FIG. 1, the washing machine further comprises a signal input unit 100, a temperature detection unit 110, a dry detection unit 120, a control unit 130, and a drive unit 140.

The signal input unit 100 inputs operation information, such as a washing course (for example, normal washing or delicate washing) selected by a user depending upon types of laundry, upon washing, using bubbles and a washing temperature (hereinafter, referred to as a "predetermined temperature"), spin-drying RPM, and addition of rinsing set by the user, to the control unit 130.

The temperature detection unit 110 detects the temperature of wash water supplied into the water tub 11, and the dry detection unit 120 detects the temperature and the humidity of the laundry to detect the dryness of the laundry.

The control unit 130 is a microcomputer to control the washing machine based on the operation information inputted from the signal input unit 100. The control unit 130 stores motor RPM and operation rate (i.e., motor on-off time), washing time, and the number of water resupply operations N (i.e., the number of water resupplies to resupply water to the first water level necessary for bubble generation when the water level is lowered due to the bubble generation) set depending upon the amount of load (i.e., the weight of laundry) in the selected washing course, and the optimum amount of wetting water Dw to wet the laundry depending upon the amount of load.

Consequently, the control unit 130 controls the amount of wash water to be supplied together with the bubble generation during bubble washing, controls the motor RPM, the operation rate, and the amount of wetting water depending upon the amount of load, and controls the start point of the bubble generation depending upon the temperature of wash water (water temperature). Specifically, the control unit 130 controls the driving of the motor 13, the water supply unit 20, and the air motor to accomplish the optimum washing efficiency while reducing the damage to the laundry.

The drive unit 140 drives the motor 13, the washing heater 16, the water supply valve 24, the water replenishment valve 32, the drying fan 41, the drying heater 44, the drainage pump 52, the cooling water valve 55, and the air motor 61 according to a drive control signal of the control unit 130.

Hereinafter, the operation of the washing machine with the above-stated construction and a washing control method of the washing machine according to an embodiment of the present invention will be described referring to FIG. 3.

According to the washing control method, it is possible to select normal washing and delicate washing depending upon types of laundry in a bubble washing course to wash the laundry using bubbles. The above-described signal input unit 100 comprises a button to input a command to select the normal washing or the delicate washing in the bubble washing course to the control unit 130.

Figure 3:
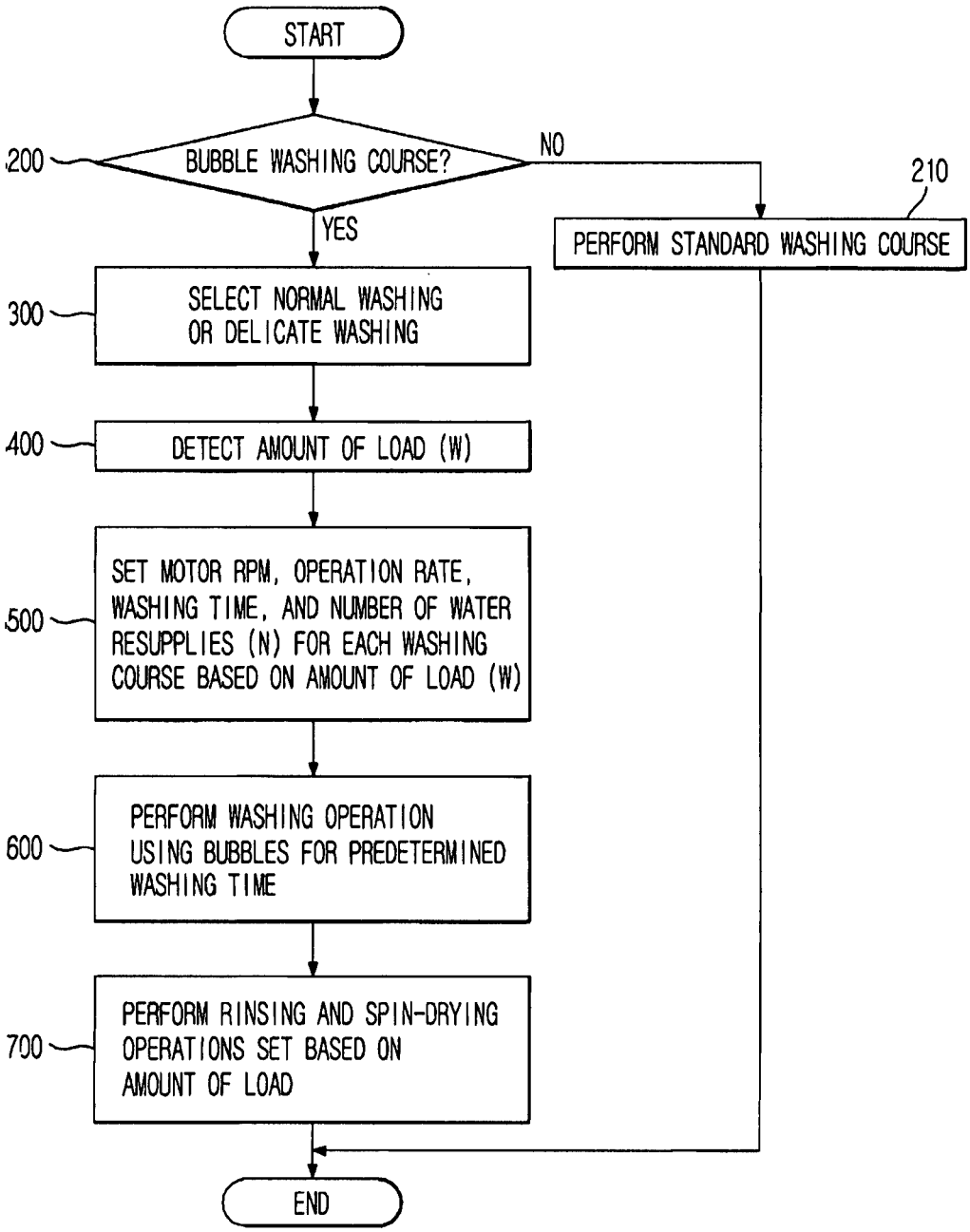
FIG. 3 is a flow chart illustrating a washing control method using bubbles in the washing machine according to an embodiment of the present invention.

FIG. 3 is a flow chart illustrating a washing control method using bubbles in the washing machine according to an embodiment of the present invention.

When a user puts laundry in the rotary drum 12 and selects a bubble washing course, the operation information selected by the user is inputted to the control unit 130 through the signal input unit 100.

Consequently, in operation 200, the control unit 130 determines whether the washing course selected by the user is the bubble washing course based on the operation information inputted from the signal input unit 100. When washing course is not the bubble washing course, the process moves to operation 210, where the control unit 130 controls a standard washing course to be performed.

When the washing course selected by the user is the bubble washing course, the user selects operation information, such as a washing course (i.e., normal washing or delicate washing), washing temperature, spin-drying RPM, and addition of rinsing, based on types of the laundry in operation 300, and the operation information selected by the user is inputted to the control unit 130 through the signal input unit 100.

Subsequently, the process moves to operation 400, where the control unit 130 detects the amount of load (i.e., the weight of the laundry) W put in the rotary drum 12 and sets the amount of wash water, the motor RPM and operation rate (i.e., motor on-off time), washing time, and the number of water resupply operations N (i.e., the number of water resupplies to resupply water to the first water level necessary for bubble generation when the water level is lowered due to the bubble generation) for each washing course based on the detected amount of load W in operation 500.

In this embodiment of the present invention, setting the number of water resupply operations N is to restrict water resupply actions depending upon the amount of laundry, thereby reducing unnecessary water supply actions.

Subsequently, the process moves to operation 600, where the control unit 130 performs a washing operation using bubbles for the predetermined washing time based on the amount of wash water, the motor RPM and operation rate, washing time, and the number of water resupply operations N, all of which are set for each washing course depending upon the amount of load W.

In the washing operation using bubbles, the bubbles serve as a cushion when the friction between laundry articles occurs, whereby the damage to the laundry due to the friction between the laundry articles and strong water stream is reduced. Also, contaminants are effectively removed from the laundry using a small amount of water by virtue of high detergent concentration of the bubbles, whereby energy is saved.

After the washing operation using bubbles is performed, the process moves to operation 700, where rinsing and spin-drying operations set based on the amount of load are performed.

Hereinafter, the process for performing the washing course using bubbles (in operation 600), which is the technical characteristic of the present invention, will be described with reference to FIGS. 4A and 4B.

Figure 4A:
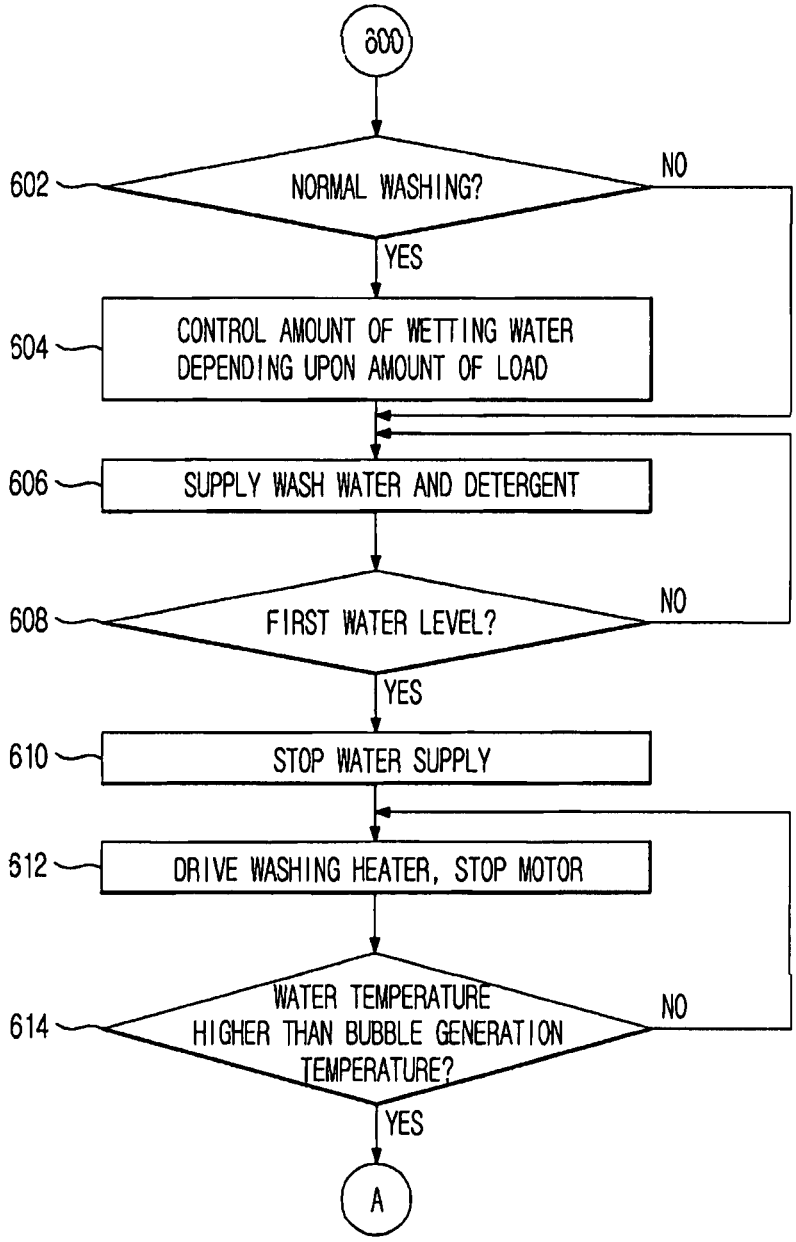
FIGS. 4A and 4B are flow charts illustrating a washing operation using bubbles in the washing machine according to an embodiment of the present invention.
Figure 4B:
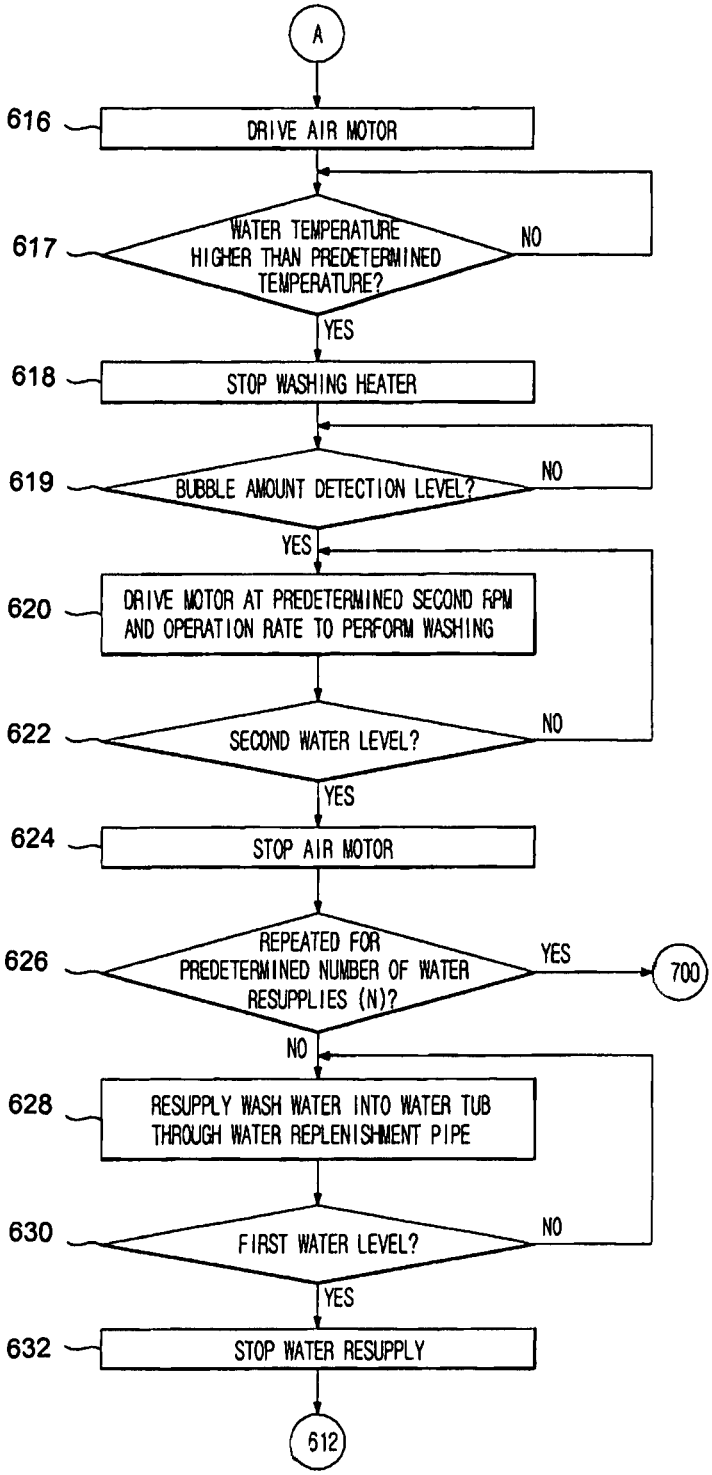

FIGS. 4A and 4B are flow charts illustrating a washing operation using bubbles in the washing machine according to an embodiment of the present invention.

First, in FIG. 4A, in operation 602, it is determined whether the washing course selected by the user is normal washing. When the selected washing course is the normal washing, the process moves to operation 604 where the control unit 130 controls the optimum amount of wetting water necessary to wet the laundry depending upon the amount of load (i.e., the weight of the laundry) W.

This is to control the optimum amount of wetting water necessary to wet the laundry depending upon the amount of load W to supply water having an amount adequate to accomplish the optimum wetting efficiency and to enable bubbles to easily permeate into the uniformly wetted laundry.

When the amount of wetting water is controlled depending upon the amount of load W to wet the laundry, the control unit 130 controls the water supply valve 24 and the water replenishment valve 32 to supply high-concentration detergent liquid necessary for bubble generation such that wash water is supplied into the water tub 11 through the water supply pipe 22 and the detergent supply unit 19 to supply high-concentration detergent liquid necessary for the bubble generation. At this time, the detergent in the detergent supply unit 19 is dissolved by the wash water and supplied together with the wash water into the water tub 11 through the connection pipe 26 and the water supply nozzle 28 with the result that concentrated detergent liquid (the wash water containing the detergent in a concentrated state) is supplied into the lower part of the water tub 11 (specifically, the space between the water tub and the rotary drum) in operation 606.

On the other hand, when it is determined at in operation 602 that the selected washing course is not the normal washing, the control unit 130 determines that the selected washing course is delicate washing, and the process moves to operation 606 to directly supply high-concentration detergent liquid necessary for bubble generation without performing the wetting control to wet the laundry depending upon the amount of load W.

By advancing to operation 606, unnecessary wetting control is omitted since the volume of the laundry is small in small-load washing, such as delicate washing, and therefore, the bubbles easily permeate into the laundry without wetting the laundry upon the washing using the bubbles. In the normal washing to wash a large amount of laundry, the laundry is wetted at the beginning of the water supply, and then the bubble washing is performed.

As the wash water containing the detergent is supplied into the water tub 11, the space between the water tub 11 and the rotary drum 12 is filled with the concentrated detergent liquid including the detergent and the wash water mixed with each other. At this time, the water level of the concentrated detergent liquid is detected by the water level sensor 17 to determine whether the water level is the predetermined first water level (i.e., the maximum wash water level at which the wash water supplied into the tub is not introduced into the rotary drum; approximately ¼ of the normal wash water level) in operation 608.

When the water level is not the first water level, wash water containing detergent continues to be supplied until the water level reaches the first water level. When the water level is the first water level, the control unit 130 turns the water supply valve 24 and the water replenishment valve 32 off to stop the supply of wash water in operation 610.

Subsequently, the process moves to operation 612, where the washing heater 16 is driven to heat the concentrated detergent liquid to a temperature suitable for bubble generation and the motor 13 is stopped such that the laundry in the rotary drum 12 is washed with the bubbles. The reason to stop the motor 13 is to rapidly heat the concentrated detergent liquid to a temperature suitable for bubble generation.

At this time, the amount of water supplied into the space between the water tub 11 and the rotary drum 12 is less than that of water in the normal washing operation. Consequently, the water is rapidly heated by the washing heater 16, and therefore, the total washing time is reduced and energy necessary to heat the water is saved.

Subsequently, the temperature of the concentrated detergent liquid (i.e., the water temperature) heated by the washing heater 16 is detected by the temperature detection unit 110 to determine whether the detected temperature exceeds a predetermined bubble generation temperature (i.e., a temperature at which bubbles are easily generated; approximately 30° C.) in operation 614.

When the water temperature does not exceed the bubble generation temperature, the washing heater 16 continues to be driven until the water temperature reaches the bubble generation temperature. When the water temperature exceeds the bubble generation temperature, as shown in FIG. 4B, the control unit 130 drives the air motor 61 to generate bubbles such that air is supplied into the concentrated detergent liquid including the detergent and the wash water mixed with each other to generate bubbles in operation 616). The bubbles are generated as follows: air supplied by the air motor 61 passes through the porous member 63 via the air supply pipe 62 with the result that the air is dispersed. The dispersed air is introduced into the concentrated detergent liquid including the detergent and the wash water mixed with each other through the air holes 64, whereby bubbles are generated.

In this embodiment, the bubble generation using the porous member 63 was described; however, the present invention is not limited to the above-described construction.

The bubbles generated in the space between the water tub 11 and the rotary drum 12 is introduced into the rotary drum 12 through the through-holes or the opening of the rotary drum 12. The bubble introduced into the rotary drum 12 is dispersed throughout the rotary drum 12 after a predetermined time (approximately 3 minutes), and therefore, the laundry in the rotary drum 12 is washed only using the bubbles.

At this time, the process moves to operation 617, where the control unit 130 determines whether the water temperature exceeds a user-predetermined temperature when the bubbles are generated by the driving of the air motor 61. When the water temperature exceeds the predetermined temperature, the process moves to operation 618, where the control unit 130 stops the driving of the washing heater to interrupt the heating of the wash water.

This is to heat the concentrated detergent liquid to the user-predetermined temperature (the minimum being approximately 40° C.) after heating the concentrated detergent liquid to the bubble generation temperature at which the bubbles are easily generated (approximately 30° C.) through the driving of the washing heater 16. When the concentrated detergent liquid is heated by the washing heater 16 and the temperature of the heated concentrated detergent liquid reaches the user-predetermined temperature, the washing heater 16 is stopped with the result that the hot water washing using the bubbles is performed at the optimum conditions desired by the user.

Subsequently, the process moves to operation 619, where the control unit 130 determines whether the bubbles introduced into the rotary drum 12 exceeds a bubble amount detection level (i.e., a level at which bubbles having an amount suitable for the washing progress are generated after the bubble generation is initiated at the first water level; a level at which approximately ⅓ of the rotary drum is filled with the bubbles).

When the bubbles exceeds the bubble amount detection level, the process moves to operation 620, where the control unit 130 drives the motor 13 to operate the rotary drum 12 at a predetermined second RPM (less than the washing RPM) and operation rate such that the washing is performed using the bubbles.

During the bubble generation, it is preferable for the predetermined RPM, operation rate, and washing time of the rotary drum 12 to be equal to or less than values set depending upon the amount of load.

The bubbles are dispersed throughout the rotary drum 12 by the rotation of the rotary drum 12 together with the bubble generation, and contaminants are effectively removed from the laundry by high detergent concentration of the dispersed bubbles. At this time, the bubbles serve as a cushion when the laundry falls and the friction between laundry articles occurs due to the rotation of the rotary drum 12, whereby the damage to the laundry is prevented.

As the washing operation using the bubbles progresses, the amount of the concentrated detergent liquid is reduced. At this time, the water level of the concentrated detergent liquid is detected by the water level sensor 17 to determine whether the water level is the predetermined second water level which is the minimum wash water level necessary for the bubble generation, i.e., the safety water level at which the washing heater is submerged in the concentrated detergent liquid in operation 622.

When the water level is not the second water level, the bubble generation is continued and the washing is performed while the rotary drum 12 is rotated until the water level reaches the second water level. When the water level is the second water level, the process moves to operation 624, where the control unit 130 stops the air motor 61 to interrupt the bubble generation.

When the water level reaches the second water level, and therefore, the air motor 61 is stopped, the process moves to operation 626, where the control unit 130 determines whether water resupply actions to resupply water necessary for bubble generation have been repeated the predetermined number of water resupplies N (S626).

When it is determined at operation 626 that the water resupply actions have not been repeated the predetermined number of water resupplies N, the control unit 130 controls the water supply valve 24 and the water replenishment valve 32 such that the wash water is not supplied to the detergent supply unit 19 through the water supply pipe 22 but to the water tub 11 through the water replenishment pipe 30, the connection pipe 26, and the water supply valve 28 to further supply water necessary for the bubble generation in operation 628. This is to maintain the bubble generation water level necessary for the bubble generation.

As the wash water is further supplied into the water tub 11, the water level in the space between the water tub 11 and the rotary drum 12 is detected by the water level sensor 17 to determine whether the detected water level is the predetermined first water level in operation 630.

When the detected water level is not the first water level, wash water continues to be further supplied (resupplied) into the water tub 11 until the water level reaches the first water level. When the water level is the first water level, the control unit 130 turns the water supply valve 24 and the water replenishment valve 32 off to stop the further supply of water (water resupply) in operation 632. Then, the process returns to operation 612, which is performed to generate bubbles until the performance is repeated the predetermined number of water resupplies N.

Hereinafter, the process for controlling the amount of wetting water depending upon the amount of load W in the normal washing of the bubble washing course to wash a large amount of laundry (operation 604 shown in FIG. 4A) will be described with reference to FIG. 5.

Figure 5:
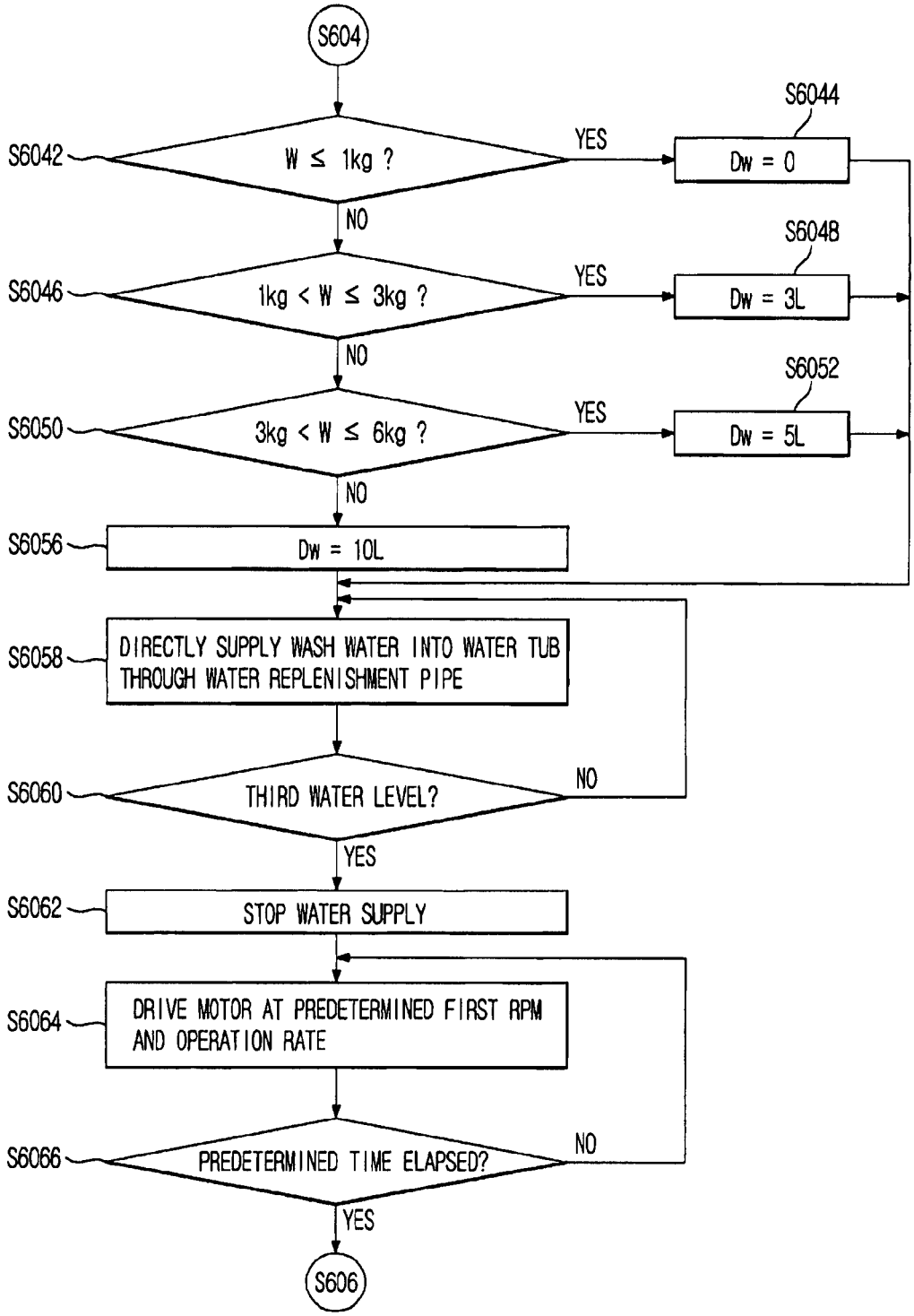
FIG. 5 is a flow chart illustrating a operation for controlling the amount of wetting water depending upon the amount of load in the washing machine according to an embodiment of the present invention.

FIG. 5 is a flow chart illustrating a process to control the amount of wetting water depending upon the amount of load in the washing machine according to an embodiment of the present invention.

When the normal washing is selected in the bubble washing course, the control unit 130 controls the amount of wetting water according to the detected amount of load W. The amount of wetting water may be controlled by the following two methods.

The first method is to increase the number of wetting times when the amount of load is increased, thereby increasing the amount of wetting water. For example, when the amount of load is 0 to 1 kg, the number of wetting times is set to be 0. When the amount of load is 1 to 3 kg, the number of wetting times is set to be 1. When the amount of load is 3 to 6 kg, the number of wetting times is set to be 3. When the amount of load is 6 to 10 kg, the number of wetting times is set to be 5. In this way, the laundry is uniformly wetted depending upon the amount of load.

The second method is to increase the amount of water to be supplied for one-time wetting, thereby increasing the amount of wetting water. For example, when the amount of load is 0 to 1 kg, the amount of wetting water is set to be 0 L. When the amount of load is 1 to 3 kg, the amount of wetting water is set to be 3 L. When the amount of load is 3 to 6 kg, the amount of wetting water is set to be 5 L. When the amount of load is 6 to 10 kg, the amount of wetting water is set to be 10 L. In this way, the laundry is uniformly wetted depending upon the amount of load.

It is possible to supply the amount of wetting water suitable for the amount of load W using any one of the above-described methods. In this embodiment, however, the second method of controlling the amount of supplied water to control the amount of wetting water depending upon the amount of load W will be described below.

Specifically, when the detected amount of load W is not more than 1 kg (in operation 6042), the amount of wetting water Dw is set to be 0 L (in operation 6044). When the detected amount of load W is more than 1 kg but not more than 3 kg (in operation 6046), the amount of wetting water Dw is set to be 3 L (in operation 6048). When the detected amount of load W is more than 3 kg but not more than 6 kg (in operation 6050), the amount of wetting water Dw is set to be 5 L (in operation 6052). When the detected amount of load W is not within the range defined at in operation 6050, the detected amount of load W is determined to be more than 6 kg, and therefore, the amount of wetting water Dw is set to be 10 L (in operation 6056).

After the amount of wetting water Dw is set depending upon the detected amount of load W, the control unit 130 controls the water supply valve 24 and the water replenishment valve 32 such that wash water necessary to wet the laundry is not supplied to the detergent supply unit 19 through the water supply pipe 22 but directly to the water tub 11 through the water replenishment pipe 30, the connection pipe 26, and the water supply valve 28 (in operation 6058).

This is to wet the laundry, before the bubble generation, to effectively perform the washing operation using bubbles such that the volume of the laundry is reduced, and therefore, the bubbles easily permeate into the laundry.

As the wash water necessary to wet the is directly supplied into the water tub 11, the water level of the wash water supplied into the water tub 11 is detected by the water level sensor 17 to determine whether the detected water level is the predetermined third water level (i.e., the amount of wetting water set depending upon the amount of load) (in operation 6060).

When the wash water level is not the third water level, wash water continues to be directly supplied into the water tub 11 until the wash water level reaches the third water level. When the wash water level is the third water level, the control unit 130 turns the water supply valve 24 and the water replenishment valve 32 off to stop the water supply (in operation 6062).

After the water supply is stopped, the control unit 130 drives the motor 13 to operate the rotary drum 12 at a predetermined first RPM (less than the washing RPM) and operation rate such that the laundry is wetted by the water supplied into the water tub 11 (in operation 6064).

During the wetting operation, it is preferable for the predetermined RPM and operation rate of the rotary drum 12 to be equal to or less than values set for each washing course depending upon the amount of load.

Subsequently, the control unit 130 counts a motor driving time to wet the laundry to determine whether a predetermined time (approximately 5 minutes) has elapsed (in operation 6066). When the predetermined time has elapsed, the process moves to operation 606, which is performed to supply high-concentration detergent water necessary for bubble generation.

In this embodiment, the wetting operation was performed in the normal washing of the bubble washing course; however, the present invention is not limited to the wetting operation in the normal washing. For example, the wetting operation may be performed in delicate washing.

Figure 6:
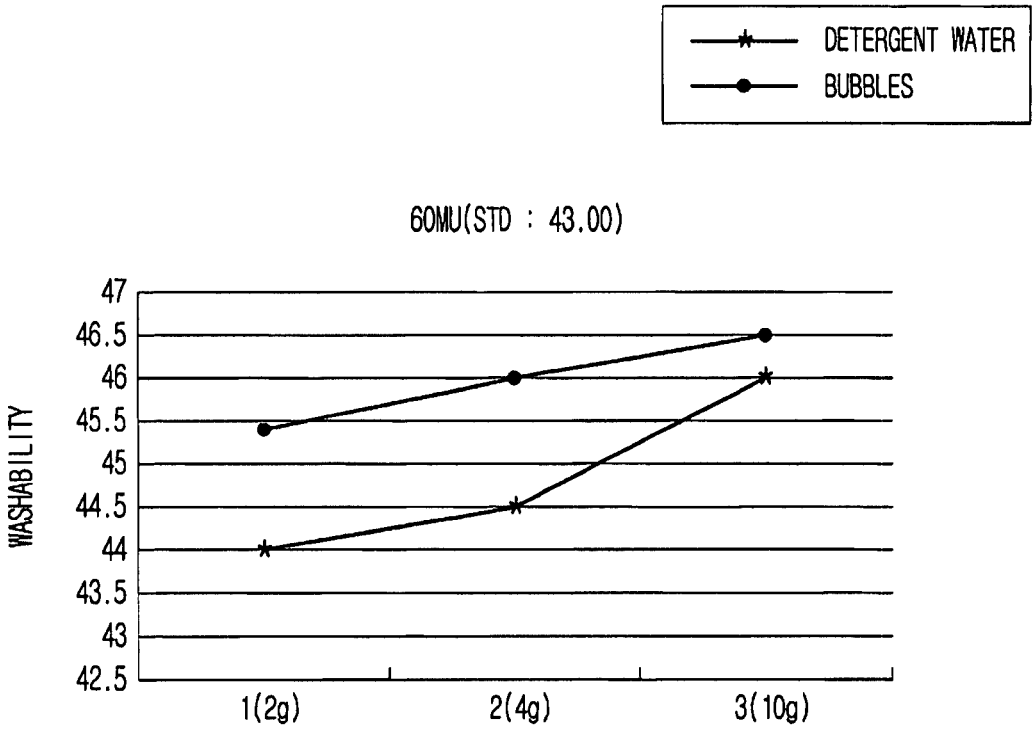
FIG. 6 is a graph illustrating washabilities when 60 MU contaminated cloth is washed using detergent water and bubbles at the same concentration according to an embodiment of the present invention.

The result of the washing operation using bubbles according to an embodiment of the present invention is shown in FIG. 6.

FIG. 6 is a graph illustrating washabilities when 60 MU (Make Up) contaminated cloth is washed using detergent water and bubbles at the same concentration. Specifically, the graph shows reflexibility (%) at amounts of detergent having the same concentration (2 g, 4 g, and 10 g).

It can be seen from FIG. 6 that the washability in the washing operation using the bubbles was higher than that in the washing operation using the normal detergent water.

As apparent from the above description, the washing machine according to an embodiment of the present invention and the washing control method of the same have the effect of performing washing using bubbles, thereby increasing washability by virtue of high-concentration detergent on bubble surfaces while reducing water consumption.

Also, the washing machine according to the present invention and the washing control method of the same have the effect of wetting laundry before bubble generation such that the bubbles easily permeate into the laundry, thereby effectively accomplishing the washing operation using the bubbles. Furthermore, the washing machine according to the present invention and the washing control method of the same have the effect of controlling the amount of wetting water necessary to wet laundry depending upon load of the washing machine, thereby supplying water having an amount adequate to accomplish the optimum wetting efficiency.

In addition, the washing machine according to the present invention and the washing control method of the same have the effect of performing wetting control to wet laundry depending upon kinds of the laundry, thereby reducing the damage to the laundry in small-load delicate washing, in which the wetting control is unnecessary, and reducing washing time.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method for use in a washing machine having a water tub and a rotary drum rotatably mounted therein to receive laundry, the method comprising:

detecting an amount of load depending upon a weight of laundry;

supplying detergent-free water containing no detergent into the water tub after laundry is loaded in the rotary drum;

wetting the laundry in the drum, wetting the laundry including operating the rotary drum at a predetermined RPM depending upon the amount of load;

supplying detergent water containing detergent into the water tub to a bubble generation water level at which the bubbles are generated while the detergent water is not in contact with the laundry in the rotary drum after the laundry is wetted;

supplying air using an air supply unit mounted below the water tub to the detergent water such that bubbles are generated as the supplied air mixes with the detergent water in the water tub below a water surface and, the bubbles generated in the water tub are introduced into the rotary drum through through-holes formed throughout the rotary drum, whereby the bubbles permeate the already wetted laundry in a plurality of directions;

detecting a water level of the detergent water changed depending upon the bubble generation;

resupplying the detergent-free water in the water tub if the water level of the detected detergent water reaches a heater safety water level; and rotating the rotary drum to perform washing of the laundry using bubbles filled therein without submerging the laundry contained in the rotary drum.

2. The method according to claim 1, wherein the supplying the detergent-free water includes controlling an amount of detergent-free water according to the detected amount of load.

3. The method according to claim 2, wherein controlling the amount of detergent-free water according to the amount of load comprises increasing the amount of detergent-free water as the amount of load increases.

4. The method according to claim 3, wherein increasing the amount of detergent-free water comprises increasing an amount of detergent-free water to be supplied for a one-time wetting operation.

5. The method according to claim 2, wherein the controlling the amount of detergent-free water according to the detected amount of load further includes increasing a number of wetting times to wet the laundry as the amount of load increases.

6. The method according to claim 1, wherein when the detergent water containing detergent is at the bubble generation water level, the bubbles are generated.

7. The method according to claim 6, wherein when the bubbles are generated exceeding a level suitable for washing, the rotary drum, in which the laundry is put, is rotated.

8. The method according to claim 1, wherein the heater safety water level is a minimum water level necessary to drive the washing heater during hot water washing using bubbles.

9. The method according to claim 1, further comprising:

setting a number of water resupplies to resupply detergent water depending upon the amount of load, wherein resupplying detergent water comprises controlling a water resupply action based on the set number of water resupplies.

10. The method according to claim 1, further comprising:

driving a washing heater to heat the detergent water containing detergent to a user-predetermined temperature, wherein heating the detergent water containing detergent to the user-predetermined temperature is carried out along with the bubble generation.

* * * * *

UNITED STATES PATENT AND TRADEMARK OFFICE

CERTIFICATE OF CORRECTION

PATENT NO. : 8,551,256 B2
APPLICATION NO. : 11/892406
DATED : October 8, 2013
INVENTOR(S) : Bo Ram Lee et al.

It is certified that error appears in the above-identified patent and that said Letters Patent is hereby corrected as shown below:

In the Claims

In Column 14, Line 51, In Claim 5, after "wherein" delete "the".

Signed and Sealed this
Eighteenth Day of February, 2014

Michelle K. Lee

Michelle K. Lee
*Deputy Director of the United States Patent and Trademark Office*